US006148513A

United States Patent [19]

Schiefer et al.

[11] Patent Number: 6,148,513

[45] Date of Patent: Nov. 21, 2000

[54] METHOD OF APPLYING A CONNECTING ELEMENT TO A HIGH-FREQUENCY CABLE IN A MOISTURE-PROOF MANNER

[75] Inventors: Jurgen Schiefer; Thomas Horn, both of Hannover; Michael Stansbie, Wedemark, all of Germany

[73] Assignee: Alcatel, Paris, France

[21] Appl. No.: 08/994,857

[22] Filed: Dec. 19, 1997

[30] Foreign Application Priority Data

Dec. 21, 1996 [DE] Germany ..... 196 54 012

[51] Int. Cl.[7] ..... H01R 43/00; H01R 9/05

[52] U.S. Cl. ..... 29/858; 29/828; 439/583

[58] Field of Search ..... 29/858, 857, 828; 439/936, 583, 578

[56] References Cited

U.S. PATENT DOCUMENTS

| | | | |
|---|---|---|---|
| 3,678,446 | 7/1972 | Siebelist | 339/177 |
| 3,818,120 | 6/1974 | Spinner . | |
| 5,002,475 | 3/1991 | Graefe | 425/135 |
| 5,137,470 | 8/1992 | Doles | 439/578 |
| 5,167,533 | 12/1992 | Rawwolf | 439/583 |
| 5,766,037 | 6/1998 | Nelson | 439/583 |
| 5,859,132 | 1/1999 | Ngoc | 525/94 |

FOREIGN PATENT DOCUMENTS

| | | |
|---|---|---|
| 0 432 662 A1 | 6/1991 | European Pat. Off. . |
| 2 718 574 A1 | 10/1995 | France . |
| PS 1943885 | 1/1979 | Germany . |
| 44 39 366 A1 | 5/1995 | Germany . |
| GM 1968186 D1 | 9/1997 | Germany . |

*Primary Examiner*—Carl J. Arbes
*Assistant Examiner*—Minh Trinh
*Attorney, Agent, or Firm*—Ware, Fressola, Van der Sluys & Adolphson LLP

[57] ABSTRACT

A method is indicated for applying a connecting element (3) in a moisture-proof manner to a high-frequency cable (1) containing at least one tubular electric conductor (7) which is surrounded by a sheath made of an insulating material. First, the sheath (10) is removed from the end of the conductor (7). Then a socket-shaped metal contact part (11,12) is attached to this end of the conductor (7) so that it makes electrical contact. A sealing material is placed between the contact part and conductor (7) on the one hand, and the contact part and the sheath (10) on the other. The sealing material for a seal (15) is made up of at least two components, which after the installation of the contact part (11, 12) enlarges its volume to such a degree that it fills the peripheral hollow space between the contact part (11, 12) and the conductor (7), and between the contact part (11, 12) and the sheath (10), at least in the transition area from the conductor (7) to the sheath (10).

10 Claims, 1 Drawing Sheet

METHOD OF APPLYING A CONNECTING ELEMENT TO A HIGH-FREQUENCY CABLE IN A MOISTURE-PROOF MANNER

BACKGROUND OF THE INVENTION

1. Technical Field

The invention concerns a method of applying in a moisture-proof manner a connecting element to a high-frequency cable containing at least one tubular electric conductor which is surrounded by a sheath made of an insulating material, whereby the sheath is first removed from the end of the conductor, whereby a socket-shaped metal contact part is then attached in an electrically conducting manner to this end of the conductor, and whereby a sealing material is applied between the contact part and the conductor on the one hand, and between the contact part and the sheath on the other.

"High-frequency cables"—hereafter abbreviated "HF cables"—may be hollow conductors or coaxial HF cables. The outer conductor of these HF cables is made of copper for example. It may be smooth or have a corrugation that runs transversely to its longitudinal axis, which gives the HF cable good flexibility and allows long lengths to be wound on reels. The contact part on the HF cable is used to connect the HF cable to another HF cable or to some device. The contact part may be a plug-in connector for example, which in the case of a coaxial HF cable also has a pin plug for the inner conductor. To avoid contact difficulties due to corrosion or a short circuit, moisture must be prevented from entering into the junction. To that end the transition from the HF cable to the contact part must be sufficiently sealed.

2. Description of the Prior Art

With a known method according to DE-PS 19 43 885, all the hollow spaces of the connecting element, which when the contacting part is installed comprise it and the enclosed parts of conductor and sheath, are filled with a viscous flexible mass. In addition, the contact part is equipped with several channels whereby the mass is distributed along the entire periphery of the conductor. The mass also seals the transition from the sheath to the bare conductor. The mass also fills recesses which may be made by the corrugation of the conductor. Any water that penetrates into the gap between the sheath and the conductor is blocked by the mass. It cannot reach the junction between the conductor and the contact part. The total effort that must be expended for this known connecting element is relatively high. A contact part with channels must be used and a special tool must be used to press the viscous flexible mass into the hollow spaces of the connecting element.

SUMMARY OF THE INVENTION

The object of the invention is to further develop the prior art method in a way so that the seal between conductor and HF cable sheath and the contact part can be achieved in a simple manner.

The invention achieves this object in that the sealing material is a sealing material containing at least two components, which after the contact part has been installed enlarges its volume in a way so that it fills the peripheral hollow space between the contact part and the conductor and between the contact part and the sheath, at least in the transition area from the conductor to the sheath.

This method presents a very simple installation of the contact part, which itself may be constructed simply. The end of the HF cable is treated in the usual manner. To that end a predetermined length of the sheath is removed from the conductor, which is then also stripped if necessary. Subsequently the socket-shaped contact part is installed so that it makes good electrical contact with the conductor. The sealing material placed in the space between contact part and HF cable on the one hand and the sheath on the other, enlarges its volume after the installation of the contact part is completed so that the periphery of at least one area of the space is filled, namely in the critical transition area from the conductor to the HF cable sheath. The completed connecting element is assured that no moisture can enter the contact area between the contact part and the conductor.

The sealing material may contain at least two components. The components can be chosen so that a variable reaction time results. The sealing material enlarges its volume after the reaction time, which can be adjusted for the respective application. To that end it can be applied for example to the outside of the HF cable before the contact part is installed, or it can also be applied to the inside of the contact part. But the sealing material can also be used so that for example one of its components is applied to the internal surface of the contact part and the other component is applied to an external surface of the HF cable before installation of the contact part. The reaction begins when the contact part is installed. The reaction that enlarges its volume then takes place through a second component which is applied to the space between the contact part and the HF cable.

The invention will be fully understood when reference is made to the following detailed description taken in conjunction with the accompanying drawing.

DETAILED DESCRIPTION OF THE INVENTION

Figure 1:
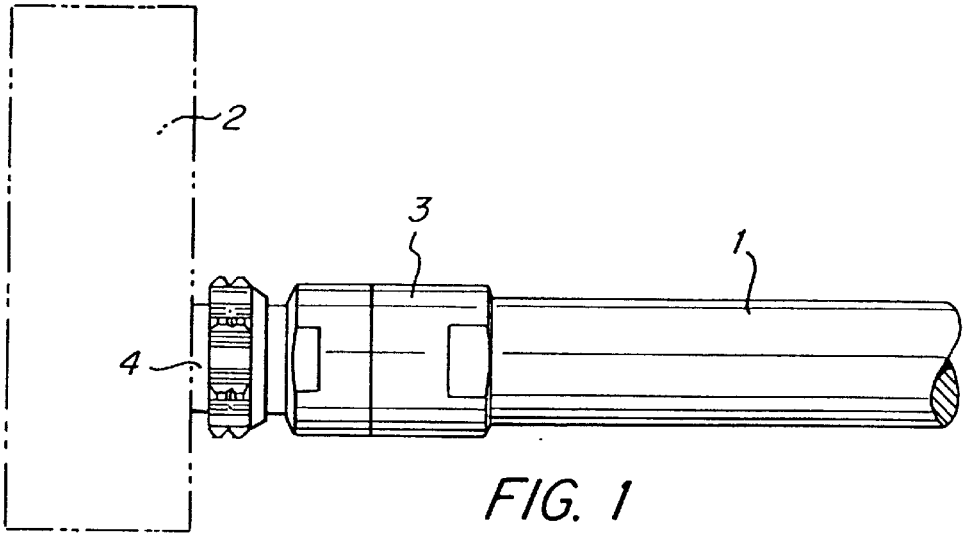
FIGS. 1 and 2 are side elevational views of two different junctions of an HF cable.

FIG. 1 illustrates an HF cable 1 which is connected to an electrical device 2. The HF cable 1 may be a coaxial cable of any type or also a hollow conductor. The end of the HF cable 1 has a connecting element 3 whereby it can be connected to a suitable connecting element 4 of the device 2.

Figure 2:
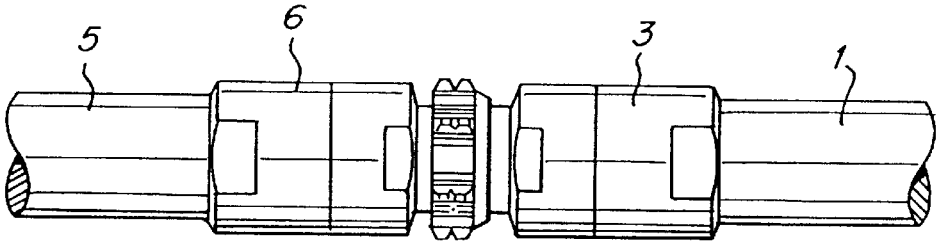

FIG. 2 illustrates the junction between two HF cables 1 and 5. In this case, the connecting element 3 is connected to a corresponding connecting element 6 which is attached to the HF cable 5.

Figure 3:
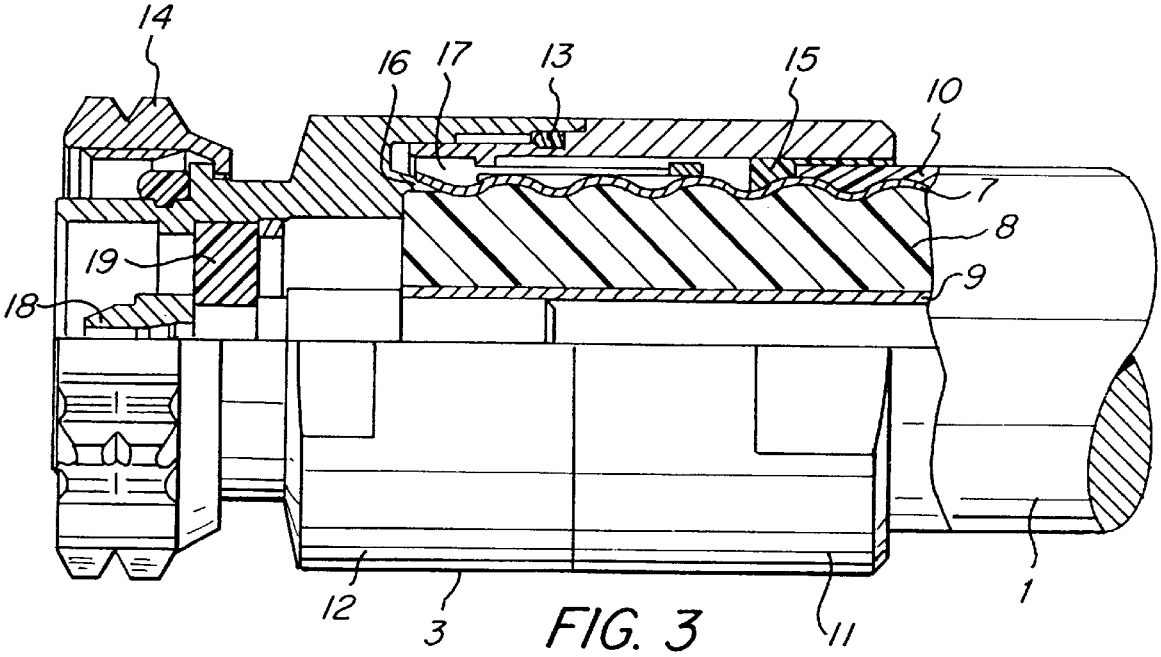
FIG. 3 is a side elevational view in partial cross section of a connecting element installed according to the invention.

According to FIG. 3, the connecting element 3 is attached to the end of a coaxial HF cable 1. The HF cable 1 in the illustrated embodiment has a corrugated tubular outer conductor 7, which concentrically surrounds an inner conductor 9 with a dielectric 8 between them. A sheath 10 made of an insulating material is placed over the outer conductor 7. The connecting element 3 is designed as a socket-shaped contact part. In the illustrated embodiment, the contact part is composed of a tubular piece 11 and a connecting part 12, which can be screwed to the tubular piece 11 for example. A seal 13 can be placed between both parts. A rotatable clamping nut 14 can be installed at the free end of the connecting part 12. The contact part surrounds the end of the HF cable 1. A sealing material 15 is installed in the space between both parts. A good electrical connection to the outer conductor 1 is provided by a peripheral ring 16 of the connecting part 12, which is pressed against the tubular piece 11 by the threaded connection, and against the outer conductor 7 by a resilient tubular pressure element 17.

With the method of the invention the connecting element 3 is installed as follows:

A predetermined length of the sheath 10 is removed from the outer conductor 7 at the end of the HF cable 1. Then, as illustrated in FIG. 3, the sealing material 15 is installed in the transition area between the outer conductor 7 and the sheath 10 so that it lies without axial interruption at least on a short axial path around the outer conductor 7 and the sheath 10 as well. After that the tubular piece 11 of the contact part with the inserted pressure element 17 is pushed over the end of the HF cable 1, and the connecting part 12 is screwed to it. The ring 16 and the pressure element 17 are thereby pressed against the outer conductor 7 on different sides. The contact part is installed in this way. The sealing material 15 is now able to enlarge its volume.

The sealing material 15 contains at least two components which lead to an enlargement of its volume after the initialization. Suitable base materials are for example polyurethane and methylmethacrylate (MMA), which enlarge their volume through the addition of well-known reaction components. The base materials and the reaction components as well must be selected or adjusted so that a permanently elastic sealing material 15 results. The two components can be mixed shortly before they are applied in the described manner to the HF cable 1, for example, in a way so that the reaction for the volume enlargement starts after 10 minutes. The installer then has enough time to install the contact part without rushing. After the reaction, the sealing material 15 fills the space to the HF cable 1 which is surrounded by the tubular piece 11. It then seals the outer conductor 7, the sheath 10 and the tubular piece 11. No moisture can now penetrate into the connecting element 3 in this essentially critical area. The contact area between the contact part and the outer conductor 7 is effectively protected against moisture.

In a deviation from the embodiment illustrated in FIG. 3, the sealing material 15 can also be applied so that the entire space between the HF cable 1 and the contact part is filled axially along its full length. By providing a suitable contact, the contact part can also be made in one piece with the outer conductor 7. The outer conductor 7 can also be a smooth tube.

With the corresponding materials, it is also possible in a kind of preparatory action to install one of the components of the sealing material 15 to the inner surface of the tubular piece 11. The reaction then takes place at an adjustable time with the second component, which is applied to the surface of the HF cable 1 before the contact part is installed. However, the components of the sealing material 15 can first be stored in a premanufactured component, for example in a ring which is deformed during the installation of the connecting element 3 so that the components are united. The enlargement of the sealing material 15 volume can then start again after a corresponding delay. With this variation, it is possible to apply one of the components in microcapsules which are broken during the installation of the connecting element 3.

In the illustrated embodiment, the connecting element 3 is mounted on a coaxial HF cable 1. To make contact with the inner conductor 9, the connecting part 12 has a central insert 18 which protrudes into the inner conductor 9 and is insulated from the connecting part 12 by a peripheral insulator 19. The contact part with the tubular piece 11 and the connecting part 12 could also be used as a connecting element for hollow conductors.

The preferred embodiment described above admirably achieves the objects of the invention. However, it will be appreciated that departures can be made by those skilled in the art without departing from the spirit and scope of the invention which is limited only by the following claims.

What is claimed is:

1. A method of applying a connecting element to a high-frequency cable in a moisture-proof manner, comprising the steps of:

(a) providing a high-frequency cable having a tubular electrical conductor with a sheath thereon made of an insulating material, the cable having an end where the conductor is not covered by the sheath;

(b) attaching a socket-shaped metal contact part to the end of the cable in an electrically conducting manner with the conductor thereby creating a surrounding area between the contact part and the conductor; and (c) applying a sealing material between the contact part and the conductor, the sealing material, after the contact part is attached, increases its volume so that the surrounding area between the contact part and the conductor is filled by the sealing material at least in a transition area from the conductor to the sheath.

2. A method as claimed in claim 1, wherein the sealing material comprises at least two components.

3. A method as claimed in claim 2, wherein at least one component of the sealing material is applied to an internal surface of the contact part before the contact part is attached.

4. A method as claimed in claim 2, wherein at least one component is chosen from a group consisting of polyurethane and methylmethacrylate.

5. A method as claimed in claim 2, further comprising the step of mixing the at least two components together before applying the sealing material so as to start a reaction between the at least two components which increases the volume of the sealing material.

6. A method as claimed in claim 5, wherein at least one component is chosen from a group consisting of polyurethane and methylmethacrylate.

7. A method as claimed in claim 1, wherein, in the applying step, the sealing material is applied to an external surface of the conductor before the contact part is attached.

8. A method as claimed in claim 1, wherein, in the applying step, the sealing material is applied to an internal surface of the contact part before the attaching step.

9. A method as claimed in claim 1, wherein the attaching step creates a surrounding area between the contact part and the sheath.

10. A method as claimed in claim 9, wherein the surrounding area between the contact part and the sheath is filled by the sealing material at least in the transition area from the conductor to the sheath.

* * * * *